US008643589B2

(12) United States Patent
Wang

(10) Patent No.: US 8,643,589 B2
(45) Date of Patent: Feb. 4, 2014

(54) RAPID DETECTION METHOD FOR DECAY OF LIQUID CRYSTAL DISPLAY DEVICE HAVING LED BACKLIGHT AND DISPLAY DEVICE PROVIDED WITH RAPID COMPENSATING DEVICE FOR DECAY

(75) Inventor: Tsung-I Wang, Tao-Yuan Hsien (TW)

(73) Assignee: Dynascan Technology Corp., Shan Hsiang, Tao-Yuan Hsien (TW)

( * ) Notice: Subject to any disclaimer, the term of this patent is extended or adjusted under 35 U.S.C. 154(b) by 811 days.

(21) Appl. No.: 12/782,653

(22) Filed: May 18, 2010

(65) Prior Publication Data

US 2011/0007055 A1 Jan. 13, 2011

(30) Foreign Application Priority Data

Jul. 8, 2009 (TW) ..... 98123093 A

(51) Int. Cl.
*G09G 3/36* (2006.01)

(52) U.S. Cl.
USPC ..... 345/102; 345/207; 345/211

(58) Field of Classification Search
USPC ..... 345/87, 100, 102, 204, 207, 211; 315/158; 702/196
See application file for complete search history.

(56) References Cited

U.S. PATENT DOCUMENTS

| | | | | |
|---|---|---|---|---|
| 5,831,586 | A * | 11/1998 | Hirai et al. | 345/94 |
| 2002/0109664 | A1 * | 8/2002 | Shimada | 345/102 |
| 2004/0095402 | A1 * | 5/2004 | Nakano | 346/102 |
| 2006/0049781 | A1 * | 3/2006 | Lee et al. | 315/312 |
| 2008/0055297 | A1 * | 3/2008 | Park | 345/205 |
| 2008/0224977 | A1 * | 9/2008 | Park et al. | 345/89 |
| 2008/0238860 | A1 * | 10/2008 | Onodera | 345/102 |
| 2009/0066631 | A1 * | 3/2009 | Lianza | 345/102 |
| 2009/0167674 | A1 * | 7/2009 | Katsu | 345/102 |
| 2009/0224678 | A1 * | 9/2009 | Wang | 315/158 |
| 2010/0110098 | A1 | 5/2010 | Wang | |

FOREIGN PATENT DOCUMENTS

CN 100360999 C 1/2008

* cited by examiner

*Primary Examiner* — Pegeman Karimi

(57) ABSTRACT

The invention relates to a rapid detection method for the decay of a liquid crystal display device having an LED backlight and a display device provided with a rapid compensating device for decay. The invention employs a mutually orthogonal series of driving signals to drive a plurality of LED devices in a synchronized manner with the driving signals having a one-to-one correspondence with the LED devices. A processing device extracts respective light emission data for the respective LED devices, compares the respective light emission data with the corresponding reference values pre-stored in the memory device and commands another device to compensate for any deviation existing therebetween. Accordingly, the LED devices are tested in batch mode and the testing is remarkably speeded up without interfering with users' activities.

16 Claims, 13 Drawing Sheets

RAPID DETECTION METHOD FOR DECAY OF LIQUID CRYSTAL DISPLAY DEVICE HAVING LED BACKLIGHT AND DISPLAY DEVICE PROVIDED WITH RAPID COMPENSATING DEVICE FOR DECAY

FIELD OF THE INVENTION

The present invention relates to display devices, and more particularly, to a rapid detection method for the decay of a liquid crystal display device having an LED backlight and a display device provided with a rapid compensating device for decay.

DESCRIPTION OF THE RELATED ART

As Light emitting diodes (LEDs) are continuously improved in luminous efficacy and cost efficiency, light crystal displays that employ LEDs as backlight light sources are increasingly adopted by the market because of their slim designs and potential to reduce power consumption. With the so-called "local color dimming control" technology developed in recent years, the adoption of LEDs as a backlight source is beneficial to modulate the regional brightness of an LCD, thereby raising the contrast ratio thereof. Especially, in the case where RGB LEDs are used in an LCD, the color gamut of the LCD can be advantageously enabled to exceed the NTSC Standard and avoid moving blur.

Typically, there are two types of white light LEDs used as backlight sources, one integrating a blue light LED chip with a phosphor powder wherein electrons of the phosphor powder are excited by the blue light and then return to their ground state to emit a light having a longer wavelength which in turn combines with the blue light to create white light; the other directly combining RGB LED chips to mix the three primaries into white light. However, regardless of the types of white light LEDs, the brightness and chromaticity values will more or less vary from one LED die to another, causing non-uniformity in light emission from diverse regions of a single backlight.

For example, in the case of a white light LED integrating a blue light chip with a phosphor powder, the brightness and chromaticity of white light emitted from the LED will be affected by the factors such as the wavelength of the blue light and the composition and mixture condition of the phosphor powder. As such, in the same batch of products, some LEDs may emit yellowish white light while the others produce bluish white light, causing the light emitted from the LED products to migrate within a range between 0.26 and 0.36 as defined by the Chromaticity Coordinates. Similarly, as described in R.O.C. Patent Publication No. 480879 assigned to the present applicant, entitled "Method to Compensate for the Color No Uniformity of Color Display," the mixed white light emitted from the LED devices that combine RGB LED chips would vary due to the slight diversity of and the possible random errors occurring in the manufacturing processes of respective LED dies.

Furthermore, the luminous intensity of LEDs will diminish over time and the light emitted therefrom will shift in frequency as well. In the case where LEDs with three primary colors are adopted to provide white light, the variation in decaying rates of LEDs gets extensive due to the increased number of LEDs mounted in a backlight. This, together with the factor that different regions of a backlight are usually operated at different environmental temperatures, lead to un-uniformity in brightness and chromaticity among different regions of a backlight and, as a consequence, an LCD-TV or a computer monitor that is provided with the LED backlight may fail to meet the basic quality requirement. Such a defect is intolerable since the human eye is very perceptive.

In order to reduce the differences in brightness and chromaticity among small areas of a backlight caused by aging of individual LEDs and improve the regional un-uniformity in brightness and chromaticity that often occurs in a backlight as a consequence of implementing the dynamic backlight area control technology, some techniques were proposed in the art, in which the overall brightness and overall chromaticity of an entire backlight are enhanced by weighting the measured values and elevating the total power supply to the backlight based on the weighted values. However, the enhancement of the overall brightness cannot effectively overcome the problem of brightness loss due to decay of individual LEDs. The regional brightness enhancement proposed in the prior art also fails to compensate for the chromaticity deviation caused by wavelength shift of the light emitted from individual LEDs.

In order to deal with the drawbacks described above, R.O.C. Patent Publication No. 480879, entitled "Method to Compensate for the Color No Uniformity of Color Display," has proposed a concept of "virtually primary color," by which the brightness loss and chromaticity deviation of a light source can be successfully compensated for. However, the patent does not focus on the efficiency of detection itself.

Other solutions to the problem of brightness loss and chromaticity deviation of LEDs mounted in a backlight were also reported lately. For example, as proposed in US2006/049781 issued to Agilent Technologies Inc., entitled "Use of a Plurality of Light Sensors to Regulate a Direct-Firing Backlight for a Display," a direct-type backlight 1 of a display device as shown in FIG. 1 is configured to include a plurality of light emitting regions 10, each having at least one LED 12. A plurality of light sensors 14 are provided such that each of the light sensors 14 is positioned to sense light produced by an LED 12 located in a corresponding light emitting region 10. If the luminous intensity of the LED 12 located in the light emitting region 10 diminishes, a processing device 16 in a control system will receive information from the light sensor and regulates light emitted from the backlight.

This method has a major disadvantage in the necessity of using multiple optical sensors. If the backlight includes only a small number of light emitting regions, a precise adjustment of variation in light performance among the regions could never happen. An increased number of the light emitting regions, however, will unfavorably result in a much more complicated structure with an intolerably high manufacture cost. Another disadvantage of the method is that the light emitted from different regions may interfere with one another, causing false detection results.

Another technique was proposed by Sony Corporation in the patent publications entitled "Display Unit and Backlight Unit" and "Apparatus and Method for Driving Backlight Unit". As shown in FIG. 2, a backlight 2 disclosed therein is divided into multiple regions 20 of same temperatures according to the temperature distribution of the backlight. Each of the regions 20 is provided with a temperature sensor and a photometric sensor (not shown). Based upon the information of temperature distribution and brightness deviation measured by the sensors, the luminous fluxes of the respective RGB dies can be adjusted to achieve uniformity in brightness and chromaticity.

This technique faces a technical difficulty in that the actual temperature distribution in the backlight 2 may not perfectly correlate to the distribution of regions 20 shown in FIG. 20. Therefore, if the respective LEDs 200 in the same region 20 are affected by different temperatures or have different degrees of aging or wavelength shift, the brightness and chromaticity levels could not be easily regulated. Another disadvantage of this technique is still the complexity of product designs with increased manufacture cost as a result of using multiple optical sensors and temperature sensors.

Frankly speaking, all of the techniques described above involve a static compensation process based on the presumption that the brightness and chromaticity levels of a backlight are maintained at fixed values. This process allows optical sensors and temperature sensors to real-time detect the brightness and chromaticity levels of a backlight and, if there exists a deviation from a corresponding reference value, provides compensation for the deviation. However, the current LCD backlight technology is advancing to develop the so-called "dynamic control" or "local area control" processes, in which a backlight is divided into multiple regions whose brightness and chromaticity levels are variable with images displayed, thereby achieving high dynamic contrast and great power-saving efficiency. In a backlight with dynamic backlight control, the brightness levels of respective LEDs vary with images displayed and, thus, are unable to be compared with reference values during frame display sections. The comparison can only be done during a blanking time between successive frame display sections.

In addition, since the backlight is mounted at the backside of an liquid crystal display module (which includes a pair of glass substrates, liquid crystal materials, a color filter, a polarizer, conductive glasses and so on), the light originally emitted from the LEDs, after reflected within the body of the display, will arrive at the optical sensor with a brightness value affected by the following factors: (1) the reflection coefficient of each wall of the backlight; (2) the reflection coefficient of each optical surface present within the liquid crystal display module; (3) the degree of opening/closing of the liquid crystal valve; (4) the incident amount of ambient light; and so on. Among these factors, the degree of opening/closing of the liquid crystal valve can be fixed by setting the liquid crystal valve in a certain state during testing. For example, the display panel can be set in a fully dark state to assure that the liquid crystal molecules are in a fully closed state where the amount of reflective or diffusing light originating from a selected LED is fixed.

In order to automatically, efficiently and precisely determine the degree of decay of the respective LEDs mounted in a backlight and compensate for the decay of individual LEDs and maintain the brightness and uniformity of the backlight at a level equivalent to that when the backlight is brand new, R.O.C. Patent Application No. 97108227 owned by the present applicant, entitled "Method for Compensating for the Attenuation of a Liquid Crystal Display Having an LED Backlight and Display That Exhibits an Attenuation Compensating Function," discloses a "synchronous-phase detection algorithm," in which a digital signal processor (hereafter, DSP) is employed to manage values detected by optical sensors. As shown in FIG. 3, the brightness control data (hereafter, BCD) output from the DSP are fixed to have a PWM duty-cycle ratio of 50% and accumulatively scored during the positive and negative phases (namely, carrying out an addition calculation during the period of a positive phase and carrying out a subtraction calculation during the period of a negative phase). For example, assuming that the BCD are transmitted to the PWM generator in the form of 10-bit data (which could present a maximum duty cycle of 100% when BCD=1023), the DSP will output a BCD value of 512, such that the PWM generator is triggered to generate a square wave of 50% High and 50% Low, which is subsequently used for driving an LED to emit light.

Since the basic pulse signals "clock" for the PWM generator come from the output of the DSP, the DSP is able to use a plurality of basic pulse signals to constitute a pulse cycle of a synchronizing signal and make the positive and negative phases in each pulse cycle to have an equal length during test. That is, when the pulse wave is in a half period of High (a positive phase) where the analog switch is in the "ON" state, LEDs are actuated to emit light. With the wave moves to a negative phase during a half period of Low where the analog switch is set in the "OFF" state, the LEDs do not emit light. The light originally emitted from the LEDs, after reflected within the backlight and display panel, will reach a phototransistor with a photocurrent $I_s$ that is exactly synchronous with the timing for LED light-emission. During the half periods of High, represented by odd numerals 81, 83, 85 . . . , the DSP accumulatively adds up the data transmitted from the A/D converter, while subtracting the data transmitted from the A/D converter during the half periods of Low which are represented by even numerals 82, 84, 86 . . . . By way of continuously performing addition/subtraction calculation during positive/negative phases in a synchronous-phase detection algorithm, the detected values during positive phases are gradually added up and augmented, whereas no value can be subtracted from during negative phases due to the absence of light emission from LEDs. As such, the more periods the DSP processes, the bigger the detected values for LED light emission become upon accumulative addition.

In contrast to LED's quick transition between bright and dark states, the signals of ambient light detected by an optical sensor are normally direct-current signals or slowly changing alternative-current signals. When the detected values for ambient light are transmitted into the DSP, the detected signal $I_n$ almost remains constant throughout all of the half periods of High 81, 83, 85 . . . and Low 82, 84, 86 . . . , such that the detected values for ambient light are nearly counterbalanced upon performing addition/subtraction calculation in the DSP during the positive/negative phases. By this way, only the detected values for LED light-emission are left after the processing by the DSP. This will significantly improve the ratio of the detected values for LED light-emission to the detected values for ambient light, so that the possible effects of ambient light may be almost eliminated.

The method described above may reasonably eliminate ambient noises, thereby ensuring that the obtained signals entirely reflect the luminous conditions of LEDs. However, as display devices increase in size, the number of LED dies mounted in a backlight gets greater and so does the number of LEDs to be tested. If the LEDs in a display device are to be tested separately in a one-by-one manner, it would take several seconds to complete the test for all of the LEDs. Given that there exists only a time interval of a few hundred microseconds (μs) between two successive frames, the enormous amount of detection and calculation time needed for testing all of the LEDs in a backlight will be forcedly divided into tiny testing sections hidden between displayed frames. As a result, the first and last tested LEDs may have experienced slightly different environmental changes (such as a variation in temperature) during the test. In other words, the detection and compensation process cannot be precisely performed due to the time-consuming nature of the test.

Therefore, there exists a need for technical means for shortening the time needed for testing a display device having an LED backlight to achieve an optimal correcting effect. The present invention provides the best solution in response to the need.

SUMMARY OF THE INVENTION

Accordingly, a purpose of the present invention is to provide a method for group-by-group detecting the respective degrees of decay of respective LED devices in a liquid crystal display device having an LED backlight by using mutually orthogonal signals and then compensating for the decay.

Another purpose of the invention is to provide a rapid detection method for detecting the respective degrees of decay of respective LED devices in a liquid crystal display device having an LED backlight and then compensating for the decay, without drawing any attention from users.

It is still another purpose of the invention to provide an automatic detection method for detecting the respective degrees of decay of respective LED devices in a liquid crystal display device having an LED backlight and then compensating for the decay.

It is still another purpose of the invention to provide a liquid crystal display device having an LED backlight that is capable of precisely detecting the respective degrees of decay of respective LED devices mounted therein and then compensating for the decay.

It is still another purpose of the invention to provide a liquid crystal display device having an LED backlight that is capable of automatically detecting the respective degrees of decay of respective LED devices mounted therein and then compensating for the decay.

It is yet still another purpose of the invention to provide a liquid crystal display device having an LED backlight that is capable of rapidly detecting the respective degrees of decay of respective LED devices mounted therein and then compensating for the decay.

The present invention therefore provides a rapid detection method for the decay of a liquid crystal display device having an LED backlight. The display device comprises a liquid crystal display module and the LED backlight comprises at least one group of LED devices with each group having a plurality of LED devices. The display device is provided with at least one optical sensor, a power supplying device for separately actuating the respective LED devices with a variable electric output, a processing device for receiving a value detected by said optical sensor and controlling the electric output of said power supplying device, and a memory device that pre-stores the respective reference values for the respective LED devices which are separately obtained by the optical sensor when the respective LED devices are lighted in an one-by-one manner at least one given power level. The method comprises the steps of:

a) at a predetermined starting time point, allowing the processing device to command the power supplying device to cut off the power supply to all of the LED devices;

b) powering the group of LED devices to emit light in a synchronized manner by providing test signal data comprised of a plurality of driving signals, wherein the driving signals are mutually orthogonal to one another and have an output power level corresponding to the at least one given power level stored in the memory device;

c) allowing the optical sensor to detect the emitted light from the group of LED devices supplied with the test signal data to obtain a detected value and converting the detected value into an electrical test signal; and d) allowing the processing device to extract respective light emission data for the respective LED devices in the group from the electrical test signal and compare the respective light emission data for the respective LED devices with the corresponding reference values pre-stored in the memory device.

The present invention further provides a liquid crystal display device having an LED backlight that is provided with a rapid compensating device for decay. The display device comprises: a liquid crystal display module; an LED backlight having plural groups of LED devices with each of the groups having a plurality of LED devices; at least one optical sensor mounted in the backlight; a power supplying device for separately actuating the respective LED devices with a variable electric output; a memory device that pre-stores the respective reference values for the respective LED devices which are separately obtained by the optical sensor when the respective LED devices are lighted in an one-by-one manner at least one given power level; and a processing device for driving the power supplying device at a predetermined time point to provide test signal data comprised of a plurality of driving signals, such that one group of the plural groups of LED devices are powered to emit light in a synchronized manner, wherein the driving signals are mutually orthogonal to one another and have an output power level corresponding to the at least one given power level stored in the memory device; and for receving the values detected by the optical sensor upon receiving the emitted light from the group of LED devices; and for extracting respective light emission data for the respective LED devices in the group and comparing the respective light emission data with the corresponding reference values pre-stored in the memory device; and for varying the electric output of the power supplying device to the respective LED devices if the respective light emission data for the respective LED devices deviate from the corresponding pre-stored reference values beyond a predetermined deviation.

In conclusion, by virtue of the invention disclosed herein, the external optical noise and interference can be effectively eliminated and the degree of decay of individual LED devices can be detected in a precise and rapid manner and the decay thereof can be compensated for in a timely manner, such that the uniformity, brightness and chromaticity in all areas of a display are ensured to be as good as brand new.

BRIEF DESCRIPTION OF THE DRAWINGS

The above and other objects, features and effects of the invention will become apparent with reference to the following description of the preferred embodiments taken in conjunction with the accompanying drawings, in which.

DETAILED DESCRIPTION OF THE INVENTION

Normally, the blanking times between successive frame display sections may only sum up to approximately 5% of the overall operation period. For a display that essentially shows 60 frames per second, a blanking time takes roughly 0.8 ms. A gist of the invention is to accomplish the correction and compensation for the poor performance of a display device during the blanking times by using an appropriate small number of optical sensors.

Figure 1:
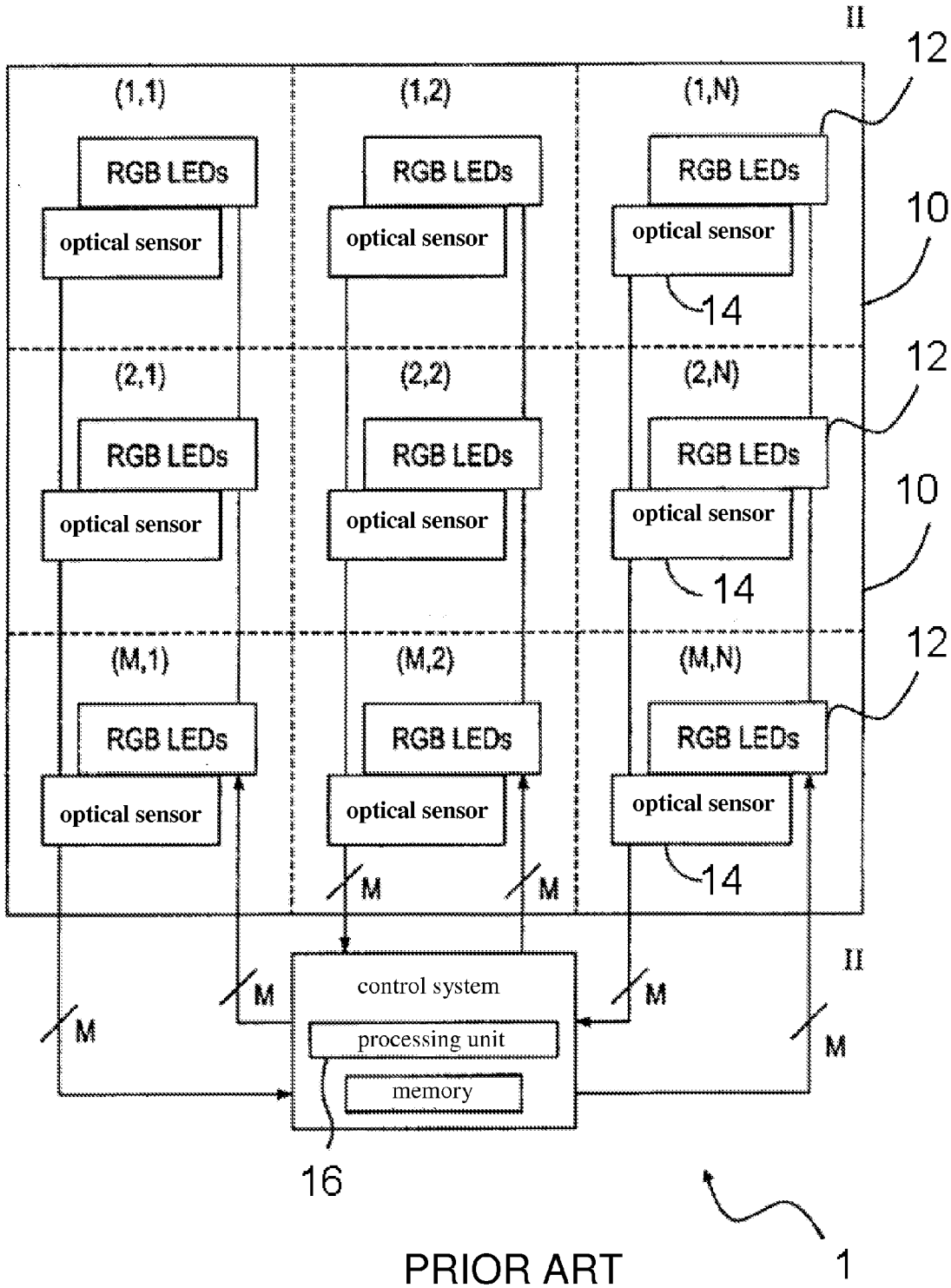
PRIOR ART Fig.1
FIG. 1 is a schematic diagram illustrating a conventional direct-type backlight mounted in a display device, wherein the backlight is adjusted by a plurality of optical sensors.
Figure 2:
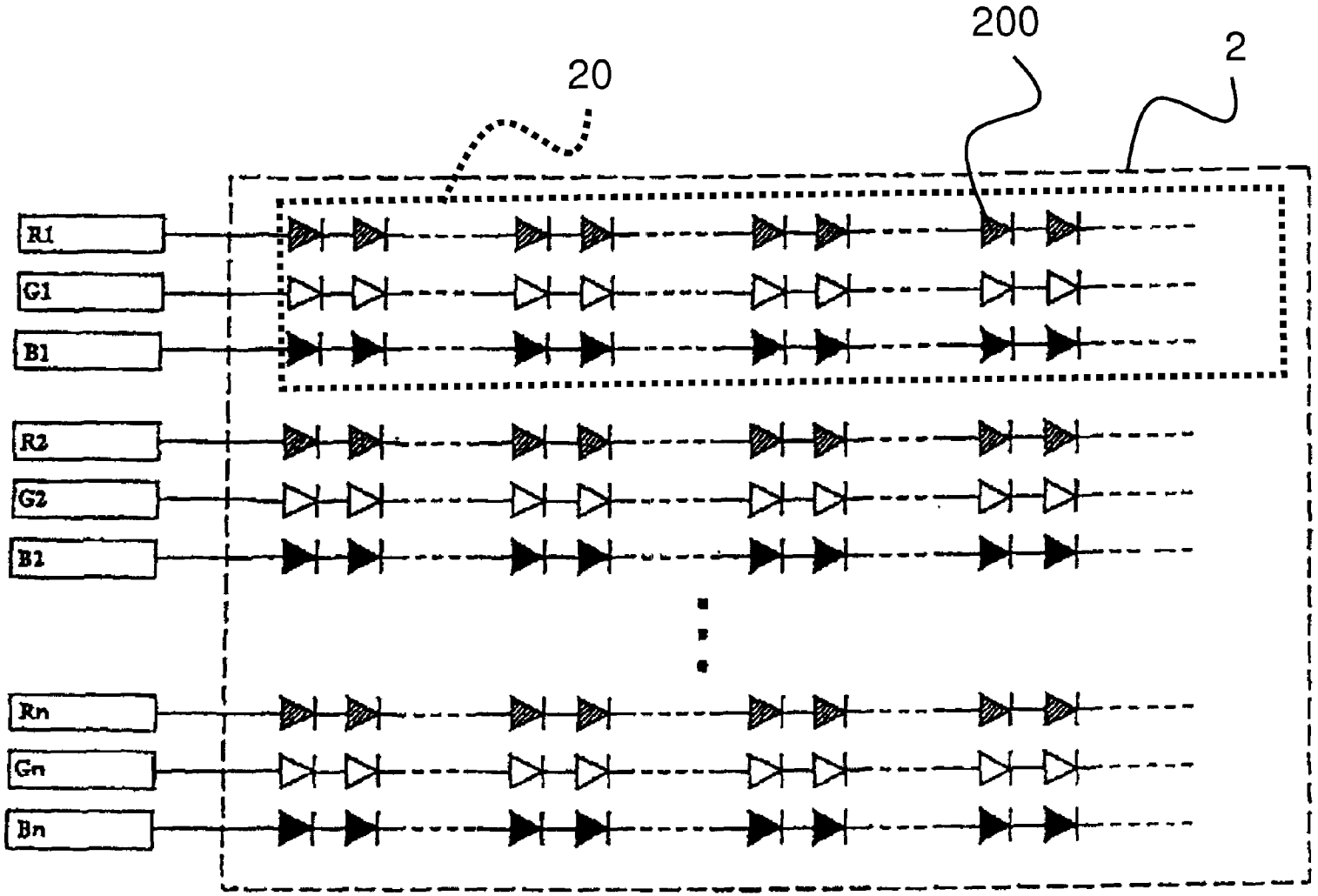
PRIOR ART FIG.2
FIG. 2 is a schematic diagram illustrating a conventional display unit, a conventional backlight unit and a conventional apparatus for driving the backlight unit.
Figure 3:
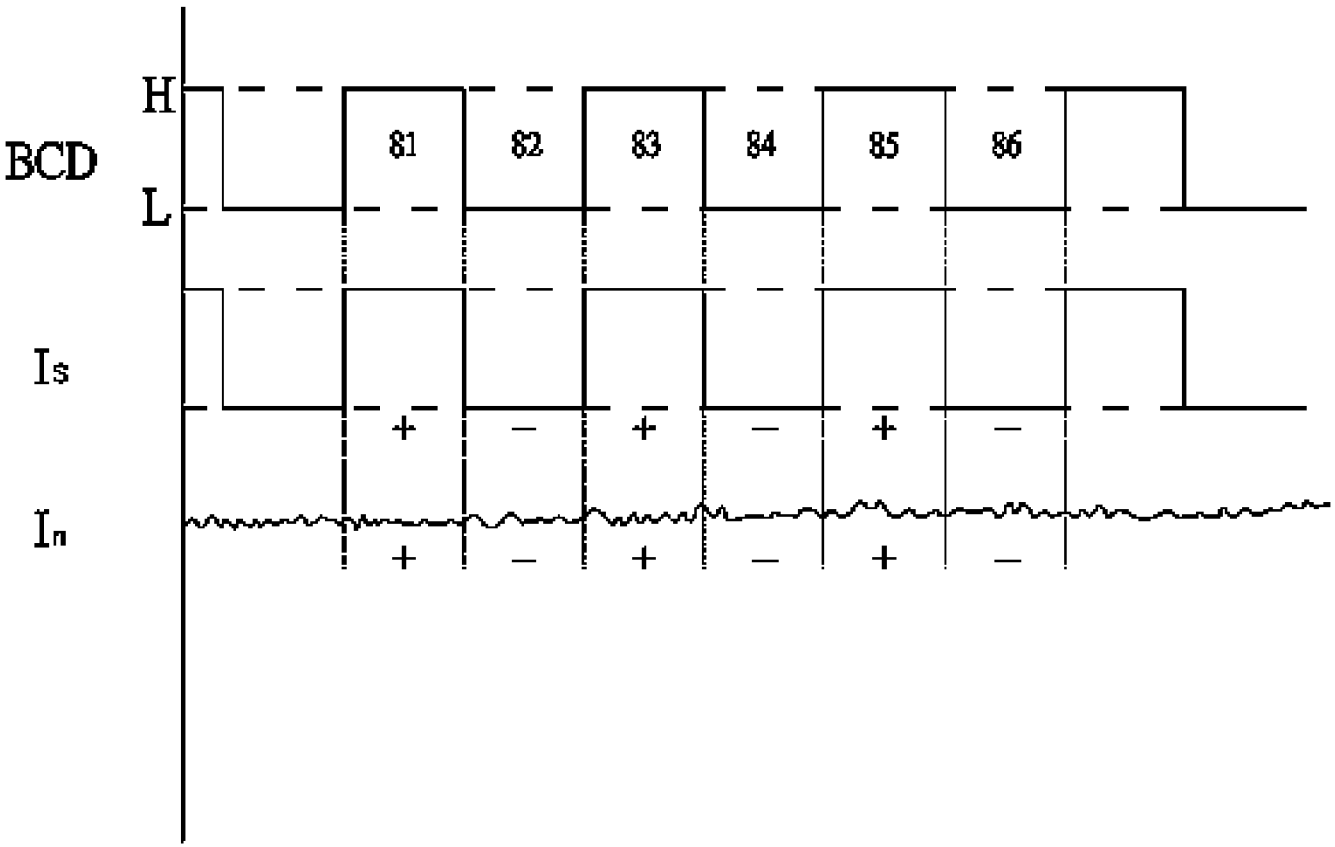
PRIOR ART Fig.3
FIG. 3 is a diagram of BCD period disclosed in a patent application owned by the applicant, entitled "Method for Compensating for the Attenuation of a Liquid Crystal Display Having an LED Backlight and Display That Exhibits an Attenuation Compensating Function"
Figure 4:
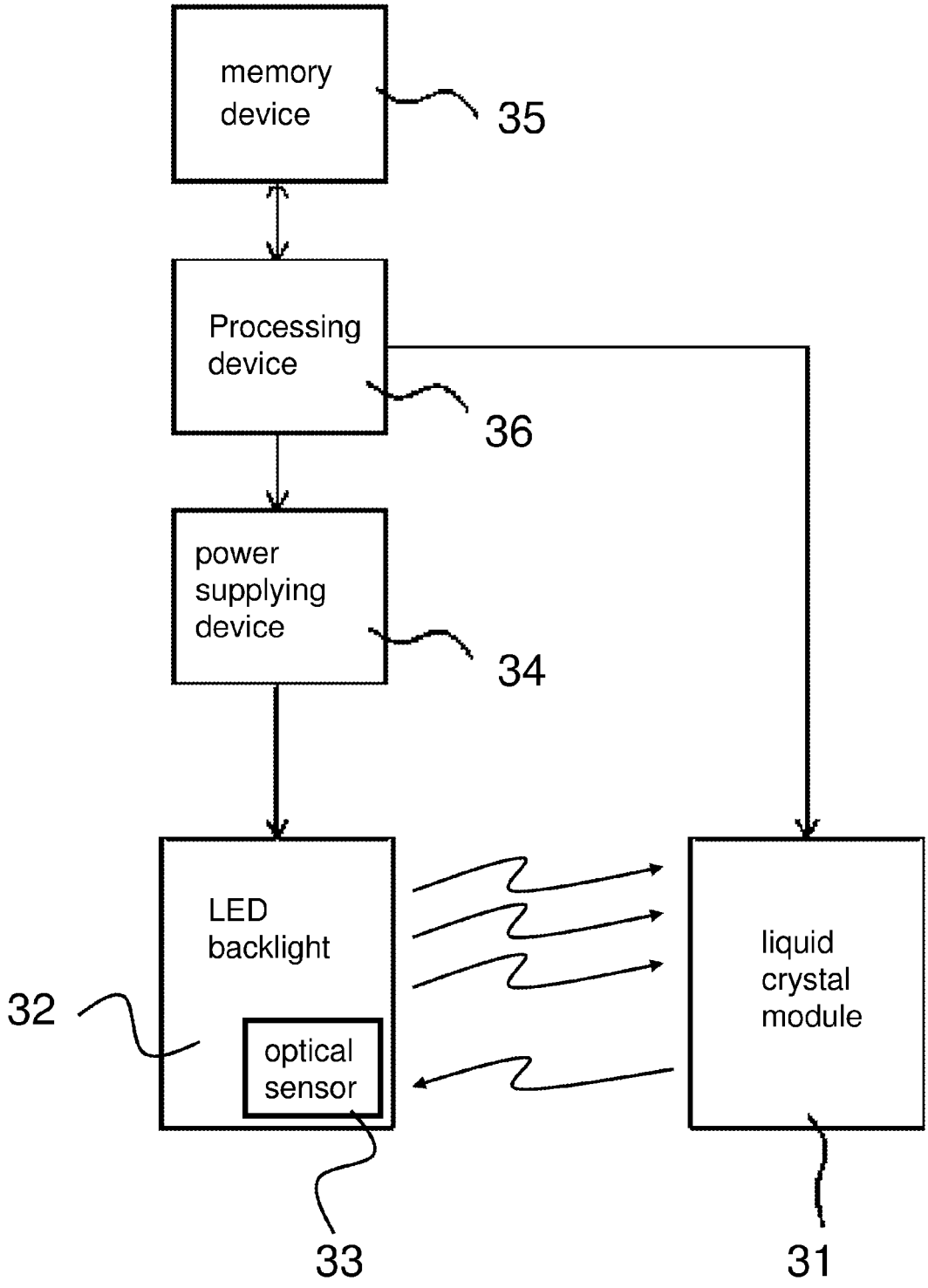
FIG. 4 is a schematic diagram illustrating the structure of a liquid crystal display device having an LED backlight provided with a rapid compensating device for decay according to the invention.

Referring to FIG. 4, the inventive liquid crystal display having an LED backlight provided with a rapid compensation device for decay includes a liquid crystal module 31, an LED backlight 32, an optical sensor 33, a power supplying device 34, a memory device 35 and a processing device 36.

Figure 5:
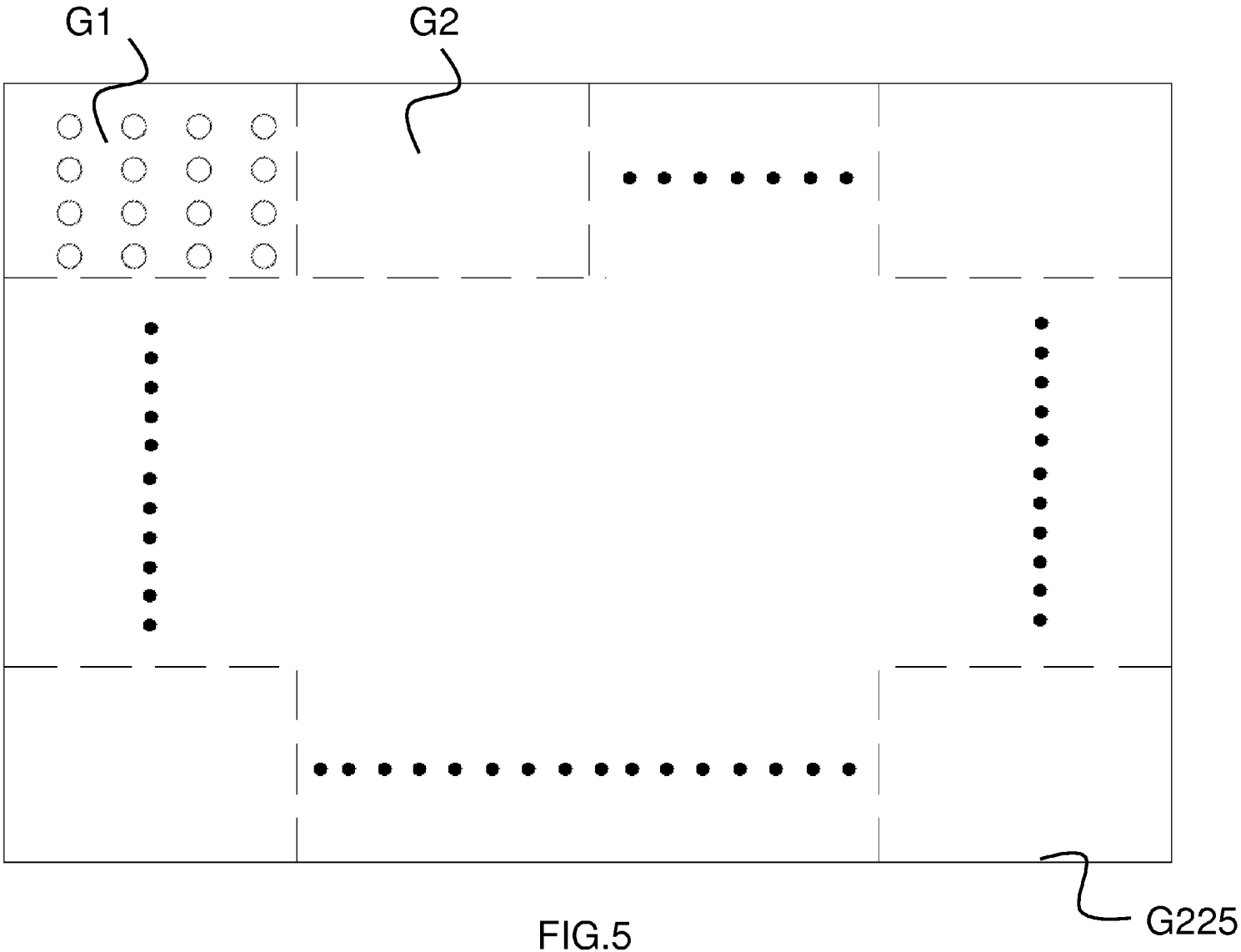
FIG. 5 is a schematic diagram showing the LED backlight according to the invention, in which LED devices are divided into groups.
Figure 6:
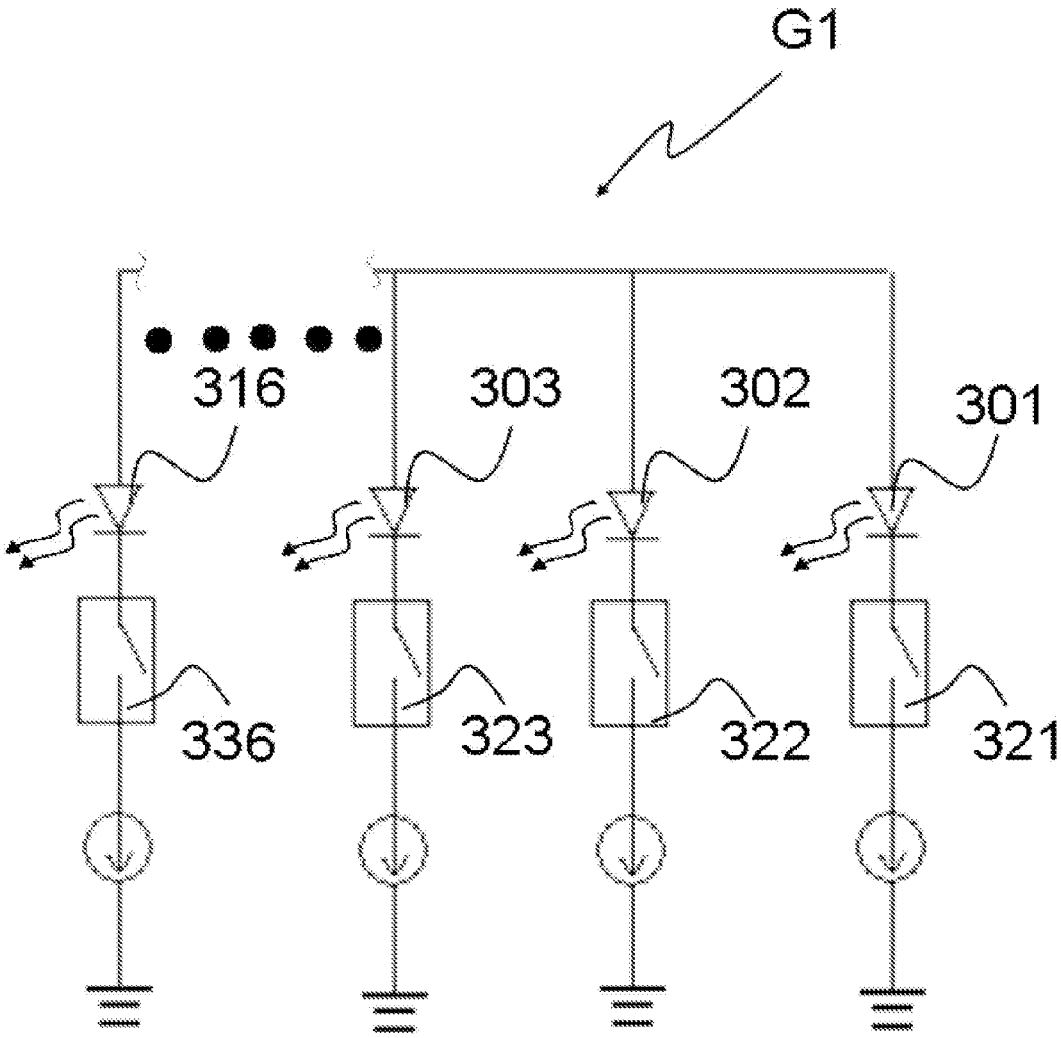
FIG. 6 is a schematic diagram showing the LED backlight according to the invention, in which LED devices are divided into groups, with each group including a plurality of LED devices.

In order to manifest the advantages of the invention, a single optical sensor is employed in this embodiment to illustrate the way in which an optical sensor may be utilized to read and detect the light-emitting conditions of respective LED devices. As shown in FIG. 5, the entire LED backlight 32 may by way of example include a total of 3600 LED devices, which are arranged into 225 groups designated G1, G2, . . . G225, with each group having 16 LEDs. As illustrated by G1 in FIG. 6, each group of LED devices may include white-light LEDs 301, 302, 303, . . . 316. The respective LED devices are electrically connected to a constant current source $I_S$ via separate operable switch elements 321, 322, 323, . . . 336 and, therefore, the lighting of the LEDs is determined by ON/OFF control of the switch elements 321, 322, 323, . . . 336. It is apparent to those skilled in the art that when necessary, a plurality of LEDs (such as three LEDs) may be connected in series to constitute an LED device. In addition, the LED devices in these groups may each be a white-light LED, or a combination of LEDs having different colors, or a single-color LED having for example anyone of R, G and B colors.

Figure 7:
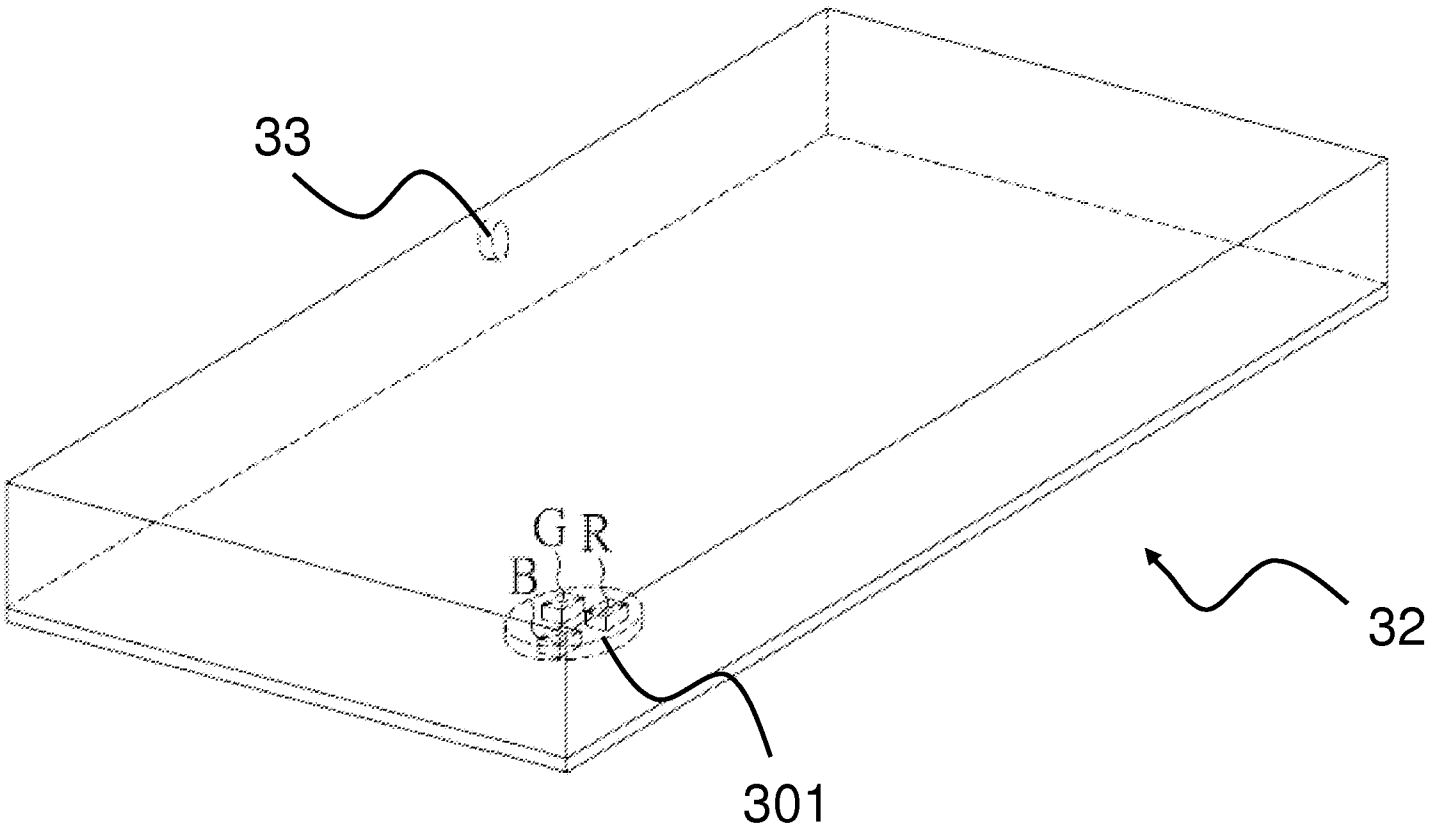
FIG. 7 is a schematic diagram illustrating an optical sensor disposed in the LED backlight according to the invention.

During each cycle of applying driving signals, the processing device regulates the ON/OFF states of the respective analog switch elements 321, 322, 323, . . . 336 to trigger tens of switching operations. The processing device further performs PWM (pulse-width modulation) control by regulating the ratio of ON period to OFF period in each switching operation. As shown in FIG. 7, a phototransistor is disposed at an appropriate position within a LED backlight 32 to serve as an optical sensor 33 for receiving the light originally emitted from the LED backlight 32 and reflected back by the liquid crystal module.

In a normal image display mode, image data are supplied to the liquid crystal module and the LED backlight 32 is powered to emit light towards the liquid crystal module for displaying images. During the time, the PWM control values for the respective LED devices 301, 302, 303, . . . 316 are determined by the control device according to the image data supplied from outside. In other words, the ON/OFF states of the respective operable switch elements 321, 322, 323, . . . 336 are determined according to the bright and dark states of the images displayed, so as to achieve the so-called "local dimming control".

Since the brightness of an LED may change with temperature and decay over time and the light emitted therefrom may also shift in wavelength, the blanking times between successive frame display sections, in which no image data are provided, are used in this embodiment as time points for detecting the light-emitting conditions of the respective LED devices in the backlight.

Accordingly, the invention is primarily characterized in that during the detection time points described above, the respective LED devices in a given group are simultaneously driven to emit light in response to receipt of test signal data comprised of multiple driving signals orthogonal with respect to one another. For illustrative purpose, the test signal data are referred to as a "mutually orthogonal" series. The supplied power is encoded into mutually orthogonal driving signals, each of which is used to modulate an LED device. The total number of the "mutually orthogonal" driving signals should be at least equal to the number of the LED devices in the given group, so that any of the driving signals will not repeat itself, wherein each of the driving signals $A_i(n)$ is a permutation of digits 1 and −1 and satisfies the following equations:

$$\sum_{n=1}^{N} A_i(n) = 0 (1 \le n \le N), \quad \text{Equation (1)}$$

$$\sum_{n=1}^{N} A_i^2(n) = N, \text{ and} \quad \text{Equation (2)}$$

$$\sum_{n=1}^{N} A_i(n) A_j(n) = 0 (i \ne j). \quad \text{Equation (3)}$$

If each of the digits 1 and −1 is defined to be a bit and each of the driving signals is defined to be a byte, then N represents the number of bits in a byte and from there "mutually orthogonal" series with various bit numbers N may be obtained using Walsh matrix method. When N=2K, the maximum possible number of distinct driving signals in a "mutually orthogonal" series is N−1. For example, when N=4, the "mutually orthogonal" series of driving signals that may be obtained are as follows:

$A_1$=(1, −1, 1, −1), $A_2$=(1, 1, −1, −1), and $A_3$=(1, −1, −1 , 1).

The three driving signals described above are substituted into

Equations (1), (2) and (3) to give the following equations:

$$\sum_{n=1}^{4} A_i(n) = 0;$$

$$\sum_{n=1}^{4} A_i^2(n) = 4; \text{ and}$$

$$\sum_{n=1}^{4} A_i(n)A_j(n) = 0(i \neq j).$$

Similarly, if the bit number N=8, the resultant "mutually orthogonal" series of seven driving signals are as follows:

$A_1$=(1 −1 1 −1 1 −1 1 −1),
$A_2$=(1 1 −1 −1 1 1 −1 −1),
$A_3$=(1 −1 −1 1 1 −1 −1 1),
$A_4$=(1 1 1 1 −1 −1 −1 −1),
$A_5$=(1 −1 1 −1 −1 1 −1 1),
$A_6$=(1 1 −1 −1 −1 −1 1 1), and
$A_7$=(1 −1 −1 1 −1 1 1 −1).

It is indicated by calculation that the seven driving signals similarly satisfy the equations $$\sum_{n=1}^{8} A_i(n) = 0; \sum_{n=1}^{8} A_i^2(n) = 8; \text{ and } \sum_{n=1}^{8} A_i(n)A_j(n) = 0(i \neq j).$$

A driving signal in a "mutually orthogonal" series is orthogonal with respect to the rest of driving signals in the same series, namely, $$\sum_{n=1}^{N} A_i(n)A_j(n) = 0(i \neq j).$$

As such, even if the respective LED devices in the same group are simultaneously powered to light and detected by a single optical sensor 33, the driving signals can still be retrieved and read out by demodulation according to the method described below. The respective LED devices in the same group will not interfere with one another and are subjected to multiple access at the same time. The multiple access leads to a 2-fold, 4-fold, 8-fold, 16-fold, 32-fold . . . increase in test rate as compared to the conventional process in which LED devices are tested in an one-by-one manner.

According to the invention, a bit value of +1 in a driving signal represents a PWM control switch being in the ON state where a corresponding LED device is powered to emit light, whereas a bit value of −1 represents the control switch being OFF. It is assumed that the light emitted from a given $LED_i$ has a value $I_i$ as detected by the optical sensor 33 when the PWM control switch associated with the $LED_i$ is ON, and that the value will turn to zero when the control switch is switched to its OFF state. If a group of LED devices are modulated by test signal data comprised of a certain "mutually orthogonal" series of driving signals $A_i(n)$, then the light emitted from the $LED_i$ device as driven by the test signals $A_i(n)$ is detected in a clock sequence of n=1, . . . N to have values equal to $\frac{1}{2}I_i(1+A_i(n))$(n=1, 2, . . . N), respectively.

Figure 8:
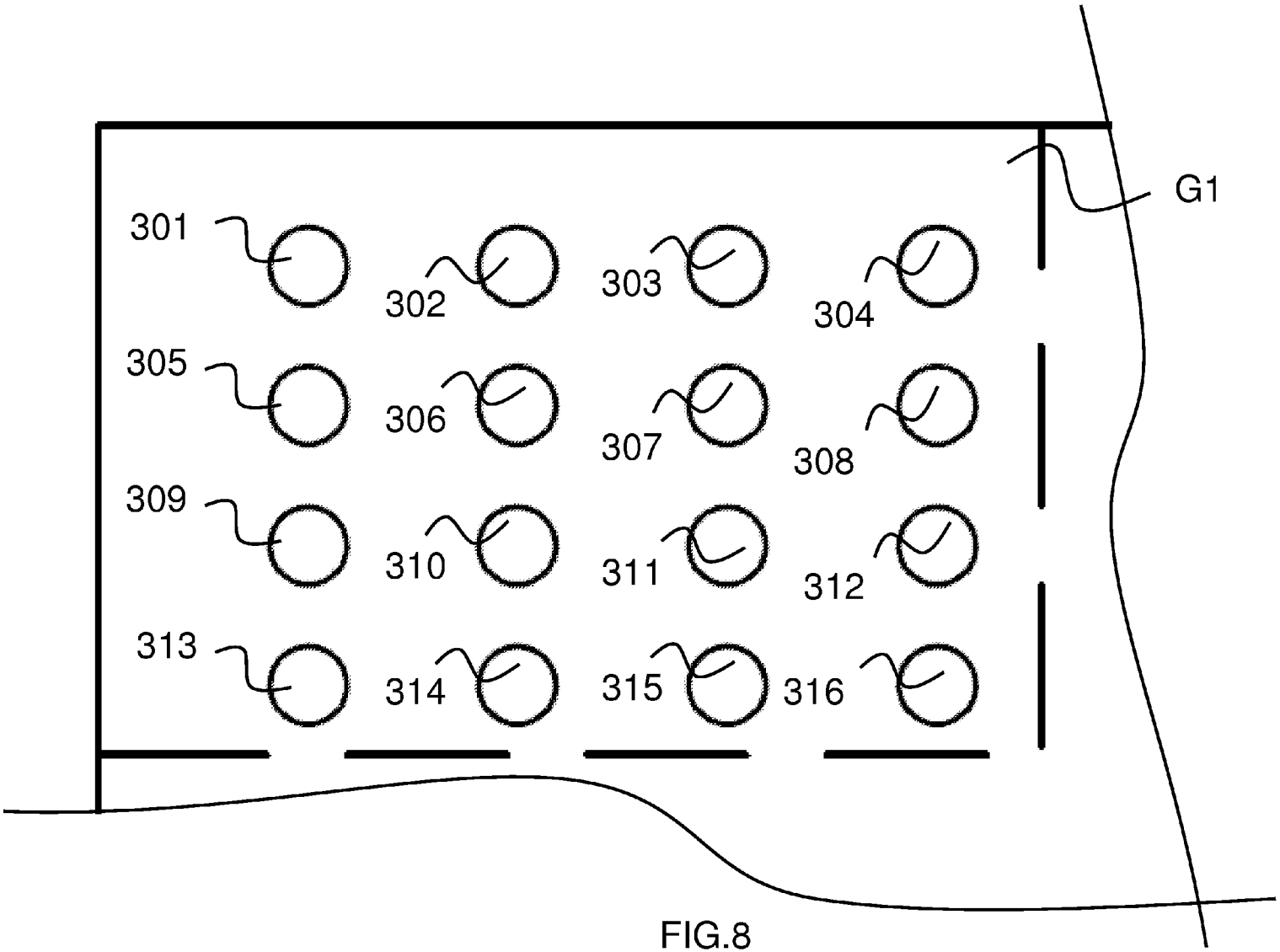
FIG. 8 is an enlarged schematic view illustrating a group of LED devices mounted in the LED backlight according to the invention.

Therefore, provided that the group G1 of LED devices 301, 302, 303, . . . 316, each being made up of a single direct-type LEDs as shown in FIG. 8, are powered and modulated by a "mutually orthogonal" series of driving signals $A_1(n)$, $A_2(n)$ . . . $A_{16}(n)$ with each PWM control signal $C_i=\frac{1}{2}(1+A_i(n))$, (n=1, 2, . . . 6), and that the light emitted from an LED is detected to have a value of $I_i$ (i=1, 2, . . . 16), and that the number of bits in a byte is set to 32 so that the "mutually orthogonal" series of driving signals are numbered to be no less than 16, the total light detected by the optical sensor in a clock sequence of n=1, 2, . . . 32 will have a detected value $$S(n) = \sum_{i=1}^{16} I_i C_i(n) = \sum_{i=1}^{16} \frac{1}{2} I_i(1 + A_i(n)), (n = 1, 2 \ldots 32).$$

Next, a signal processor DSP is used to analog/digital (A/D) convert and demodulate the total detected value S(n) into the optical detected values for the respective LED devices 301, 302, 303, . . . 316. For example, the optical detected value $I_1$ for the LED device 301 can be demodulated from S(n) by allowing the DSP to process $$\sum_{n=1}^{32} S(n)A_1(n),$$

in view of the relationship $$\begin{aligned}
\sum_{n=1}^{32} S(n)A_1(n) &= \sum_{n=1}^{32}\sum_{i=1}^{16} \frac{1}{2}(1 + A_i(n))I_i \cdot A_1(n) \\
&= \frac{1}{2}\sum_{n=1}^{32}\sum_{i=1}^{16} I_i A_1(n) + \frac{1}{2}\sum_{n=1}^{32}\sum_{i=1}^{16} I_i A_i(n)A_1(n) \\
&= \frac{1}{2}\sum_{i=1}^{16} I_i \sum_{n=1}^{32} A_1(n) + \frac{1}{2}\sum_{i=1}^{16} I_i \sum_{n=1}^{32} A_i(n)A_1(n) \\
&= \frac{1}{2}\sum_{i=1}^{16} I_i \cdot 0 + \frac{1}{2}\sum_{i=1}^{16} I_i \delta_{i1} \cdot 32 \\
&= 0 + \frac{1}{2} I_1 \cdot 32 = 16 I_1,
\end{aligned}$$

$$\text{and gives } I_1 = \frac{1}{16}\sum_{n=1}^{32} S(n)A_1(n).$$

Similarly, the DSP processing of $$\sum_{n=1}^{32} S(n)A_2(n)$$

gives 16 $I_2$.

Therefore, from the sum values $S_1$, $S_2$, $S_3$, . . . $S_{32}$ detected by the optical sensor, the respective detected values for the 16 LED devices 301, 302, 303, . . . 316 can be obtained based upon the relationship $$I_k = \frac{1}{16}\sum_{n=1}^{32} S(n)A_k(n).$$

In particular, a "mutually orthogonal" series of driving signals are used to modulate the respective devices, and the respective driving signals in the "mutually orthogonal" series are subsequently used to multiply with the total detected values to accomplish a synchronized demodulation. Given that the synchronized demodulation algorithm includes a step of multiplying the respective driving signals back with the total detected values, and that each of the driving signals has exactly half of the bit values equal to +1 and the other half equal to −1, the ambient signals which are asynchronous with the driving signals and interfere with the detected result of the optical sensor will be demodulated in clock sequence during the demodulation process, with half of them being multiplied with +1 and the other half with −1. The adverse effects caused by the ambient signals are significantly reduced after processing, and this is particularly true as the bit number in a driving signal byte increases. Therefore, the embodiment disclosed herein may further perform an anti-noise function.

An elongated sequence of a driving signal (i.e., an increased length of a byte) increases effectively the signal-to-noise ratio, thereby facilitating the anti-interference function. The interference described herein may come from ambient light. For example, when sunlight radiates to an indoor display device, an optical sensor mounted in the display device may be interfered to generate an ambient signal $N_s$. As a consequence, the total detected value by the optical sensor turns out to be $S(n)+N_s$. If the total detected value is demodulated by $A_i(n)$, the resultant demodulated signals would be as good as the signals obtained in the absence of the ambient signal, provided that $$\sum_{n=1}^{32} N_s A_i(n) = 0.$$

It is readily apparent to those skilled in the art that a "mutually orthogonal" series of driving signal sequences can be extended in length or, in other words, the number of bits in a byte can be increased by repeating the original signal bytes several times. For instance, assuming that the number of bits in an original byte is 8, the byte can be easily multiplied by repeating the 8 bits in the same order. In this case, the driving signals from $A_1$ to $A_7$ as described above may turn into a series of 16-bit signals by duplicating themselves:

$A_1'$=(1 −1 1 −1 1 −1 1 −1, 1 −1 1 −1 1 −1 1 −1)

$A_2'$=(1 1 −1 −1 1 1 −1 −1, 1 1 −1 −1 1 1 −1 −1)

(The same processing is performed to obtain $A_3'$ to $A_6'$.)

$A_7'$=(1 −1 −1 1 −1 1 1 −1, 1 −1 −1 1 −1 1 1 −1).

Meanwhile, the characteristic "mutually orthogonal" relationship among $A_1', A_2', \ldots A_7'$ remains the same. That is to say, Equations (1) and (3) are kept unchanged and only the number of digits in Equation (2) is doubled as compared to the original, namely, $$\sum_{n=1}^{16} A_i^2(n) = 16.$$

The use of driving signals having a longer sequence (i.e., having a larger bit number) for executing modulation will remarkably elevate the anti-interference ability during test, but would disadvantageously double the time for testing a given group of LEDs.

It is found by substituting actual values into the examples above that a bit cycle would be 1 μs, if the bit frequency is set to 1 MHz. When the length of a driving signal corresponds to a byte including n=64 bits, to test a total of 3600 LED devices mounted in a backlight of a display device in an one-by-one manner takes 3600×64 μs which is equal to 230.4 ms, despite achieving a 64-fold increase in anti-interference ability. For a display that shows 60 frames per second and each frame takes 16.6 ms to display, in which the blanking times between successive frame display sections only sum up to 5% of the overall operation period and a blanking time takes roughly 0.8 ms, a total of 288 blanking times are needed to complete the test. In other words, it takes around 4.8 seconds to test the entire display device if the total blanking time per second is 60.

In contrast, the embodiment disclosed herein subjects a group of 16 LED devices to a synchronized test. Given that each of the driving signals is 64 bits in length with all bits having the same cycle length, the invention achieves a 16-fold increase in test rate and only 18 blanking times are needed to complete the test. Since a 64-bit byte is exemplified herein for a driving signal, the entire series may include as many as 63 "mutually orthogonal" driving signals, so that the possible number of LED devices that can be lighted and tested synchronously is increased to 60 per group. As a result, a complete test can be done by using only 5 blanking times and within 1/12 sec.

Figure 9:
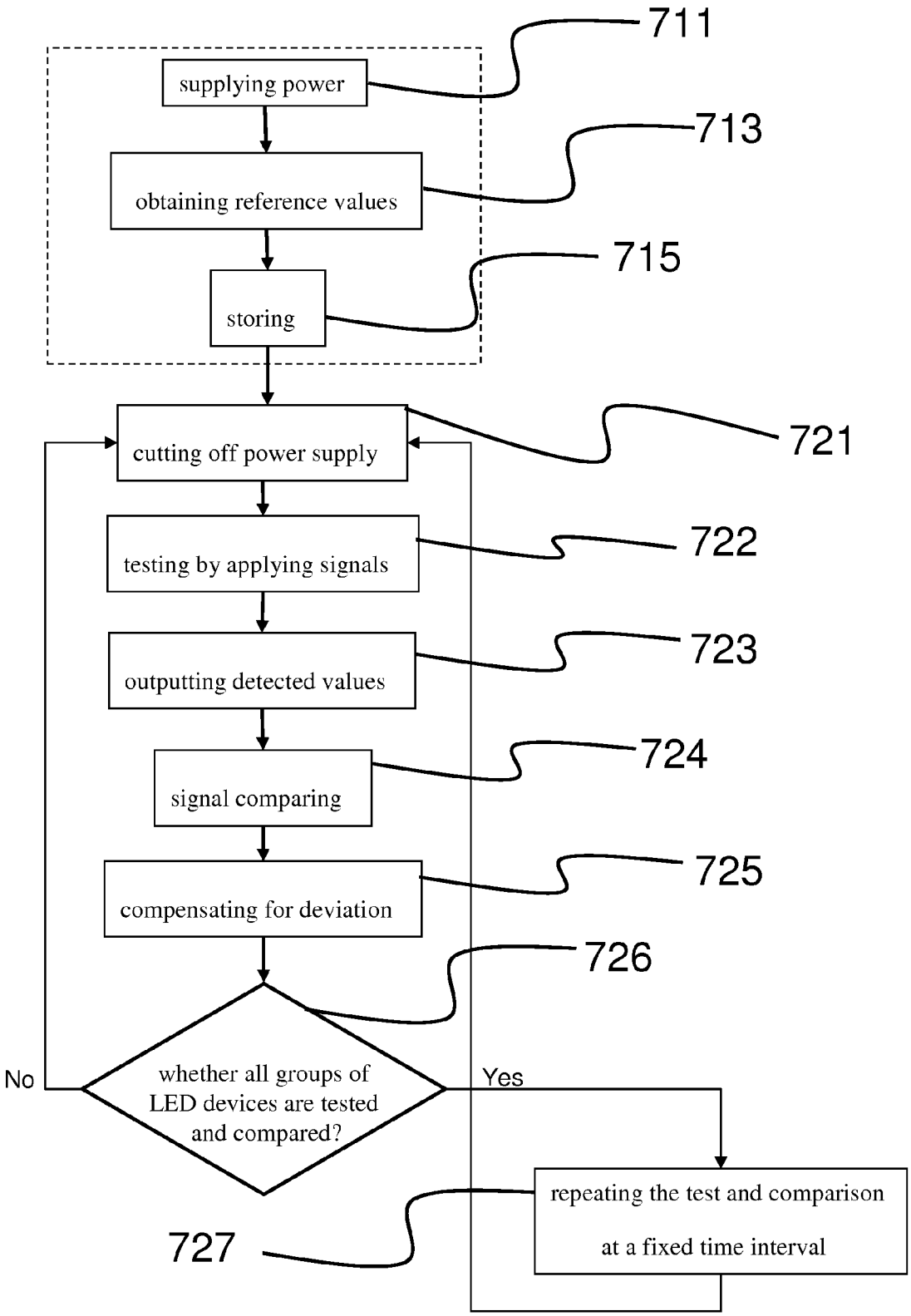
FIG. 9 is a flow chart showing the procedure of testing the respective LED devices mounted in the LED backlight according to the invention.

Referring to the flow chart shown in FIG. 9, and according to the embodiment disclosed herein, in Step 711, the LED devices mounted in a backlight of a display device are powered to light at least one given power level before the display device leaves the plant, and then in Step 713, the lighting conditions of the LED devices at the at least one given power level are detected by a optical sensor. In Step 715, the detected brightness and chromaticity levels of the respective $LED_i$ devices mounted in the backlight are recorded as standard detected values $I_{si}$.

Next, in Step 721 according to the flow chart described above, the processing device first gives a command in the blanking times to terminate the power supply to all of the LED devices mounted in the backlight, such that the LED devices under test will not be interfered by the rest of LED devices mounted in the backlight. In Step 722, the "mutually orthogonal" series of driving signals described above are then provided as test signal data for powering a given group of LED devices to light in batch mode, wherein the driving signal received by any given LED device in the group is orthogonal with respect to the driving signals received by the rest of the LED devices in the same group. Therefore, the number of the mutually orthogonal driving signals should be at least equal to the number of LED devices in the group.

In Step 732, an optical sensor is provided to detect the overall light emission from the group of LED devices powered by the test signal data and convert the detected value into an electrical test signal which is in turn transmitted to the processing device. In Step 724, the processing device multiplies the respective driving signals with the electrical test signal according to the embodiments described above, such that the electrical test signal is demodulated to obtain the luminous data of the respective LED devices. The obtained luminous data are then compared with the corresponding detected values pre-stored in a memory device (namely, the standard detected values $I_{si}$ for the respective LED devices). For example, if a demodulated detected value $I_i$ deviates from the corresponding standard detected value $I_{si}$ beyond a predetermined deviation, such as a 5% deviation in brightness, adjustment data would be obtained by calculation in Step 725 for compensation for the deviation, such that the deviation is compensated for by adjusting the PWM driving value for the $LED_i$ during the subsequent frame display sections.

In general, a ratio of the standard detected value $I_{si}$ to the demodulated detected value $I_i$, namely, $(I_{si}/I_i)$, can serve as a PWM ratio for the corresponding LED. Since the comparison of the respective LED devices is based upon the data obtained by the same optical sensor, any deviation in the luminous conditions of the respective LED devices, regardless of resulting from variation in ambient temperature or differential aging of the LED devices, can be successfully compensated for such that the detected values of the respective LED devices are restored to a level equal to the standard detected values measured when the display device is ready to leave the plant. According to the inventive process, the brightness and chromaticity of the LED devices can be adjusted to achieve sufficient uniformity, and the quality of the backlight can be restored to a level comparable with the original quality that the backlight has when it is ready to leave the plant.

In this embodiment, the group-by-group testing procedure for LED devices is continuously carried out during the blanking times by the processing device until Step 726 confirms that all of the groups have been tested. According to the technique disclosed herein, the test and compensation described above can be achieved within a short period of time. Therefore, in Step 727, the procedure from Step 721 to Step 726 may be repeated whenever the display device is consecutively operated for a given period of time, such as for an hour, so as to ensure the display quality of the display device at all time. As an alternative, the test and compensation procedure according to the invention may continuously perform throughout the operation of the display device by taking advantage of its time-saving features, thereby ensuring that the display quality of the display device is as good as brand new.

The sensitivity of an optical sensor may change slightly at different temperatures. However, this only affects the absolute brightness values detected by the optical sensor and presents no effect on the relative detected values for the LED devices. That is to say, there may be a slight change in the absolute brightness values, but the uniformity in relative brightness and chromaticity levels remains unchanged. If desired, optical sensors equipped with an internal temperature compensation circuit may be employed in the invention to obtain the exact brightness values free of temperature effect.

Figure 10:
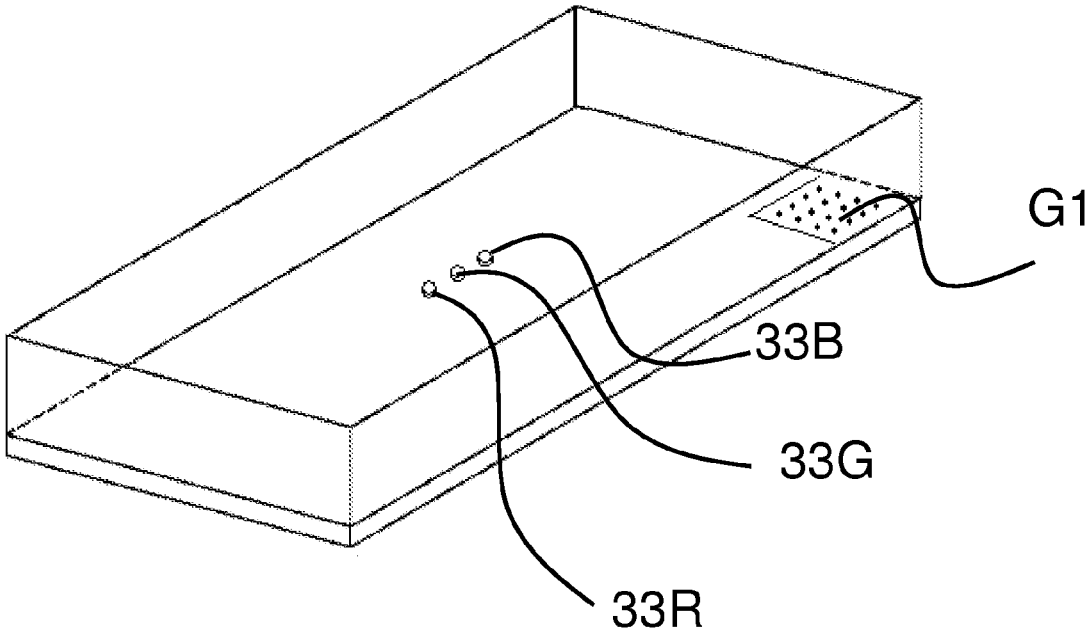
FIG. 10 is a schematic diagram showing a plurality of color-photometry sensors mounted in the LED backlight and used for detecting red, green and blue light, respectively.
Figure 11:
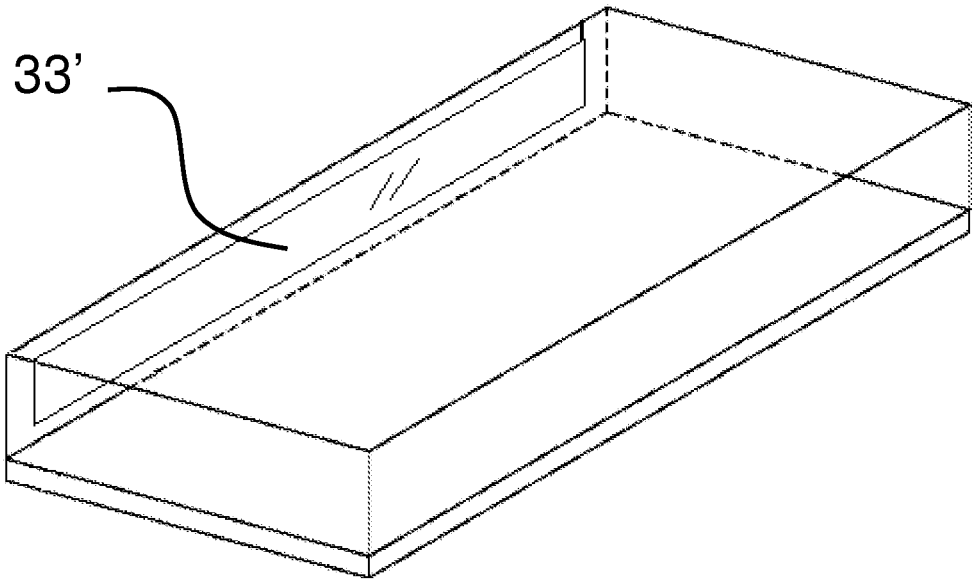
FIG. 11 is a schematic diagram illustrating an LED backlight according to the invention, in which a solar cell is shown to serve as an optical sensor.

The phototransistor used in the previous embodiments is not the only option for the optical sensor according to the invention. Additional examples of the optical sensor include color-photometry sensors 33R, 33G and 33B which, as illustrated in FIG. 10, are mounted in a backlight for detecting red, green and blue lights, respectively, or a solar cell 33' shown in FIG. 11. The optical sensor(s) may be further assisted by a voltage amplifier for amplifying the values detected by the optical sensor and an analog/digital converter for converting the electrical signals output from the voltage amplifier, thereby converting the detected data for groups of LED devices into digital signals and transmitting the same to the processing device.

Figure 12:
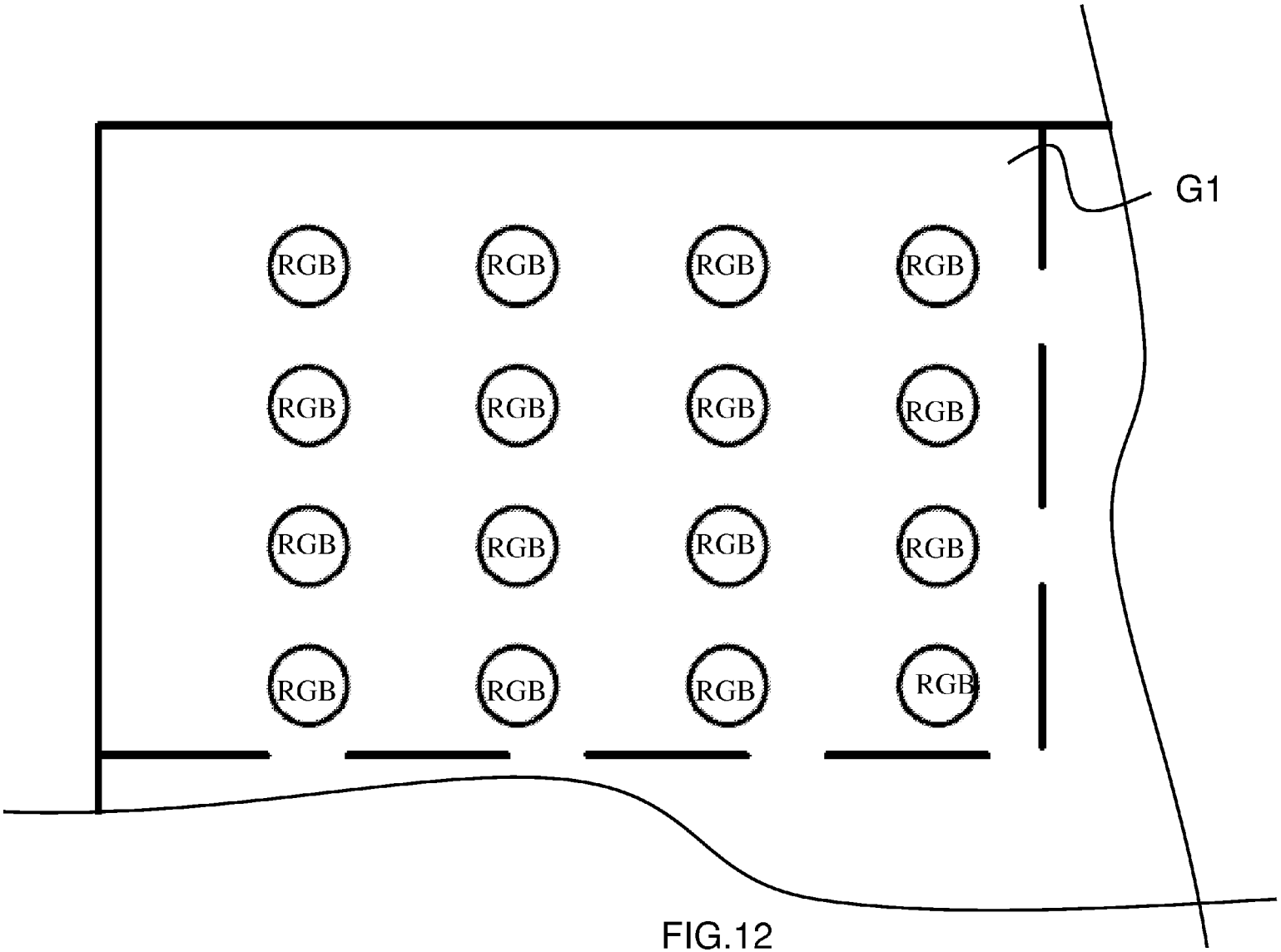
FIG. 12 is an enlarged schematic view illustrating a group of LED devices mounted in the LED backlight according to the invention, in which the group comprises a plurality of LED light sources, each being made up of R, G and B LED dies.

Furthermore, according to the embodiment shown in FIG. 12, a light source group G1 comprises a plurality of "three-in-one" LED light sources, each being made up of intimately disposed R, G and B LED dies. However, the disposition of R, G and B LED dies in the same light source may give rise to an undesired change in overall brightness and chromaticity levels of the light source as compared to those when the display device leaves the plant due to their differences in decay rate and response to ambient temperature. Further, some advanced high-level applications in display devices are premised upon successful compensation not only for loss of brightness but also for chromaticity deviation caused by wavelength shift of the emitted light. Therefore, the 33R optical sensor of this embodiment is selected to have a spectral responsibility close to the standard response function $\bar{X}(\lambda)$ according to the CIE 1931 standard colorimetric system, whereas the 33G optical sensor has spectral responsibility close to the standard response function $\bar{y}(\lambda)$ and the 33B optical sensor has spectral responsibility close to the standard response function $\bar{Z}(\lambda)$. In this embodiment, the R, G and B LED dies disposed in the same LED light source are each associated with a separate PWM control switch and, hence, are each considered as an LED device for test.

As described above, before leaving the plant, the respective LED light sources in this embodiment are detected under a certain standard condition by a "standard photo-detector" to determine the tri-stimulus values thereof, which are designated as $X_{1r}$, $X_{2r}$, $X_{3r}$; and $X_{1g}$, $X_{2g}$, $X_{3g}$; and $X_{1b}$), $X_{2b}$, $X_{3b}$, respectively. The nine stimulus values represent the brightness and chromaticity levels necessary for achieving standard white light, wherein $X_{10}=X_{1r}+X_{1g}+X_{1b}$ serves as the X stimulus value for white light, $X_{20}=X_{2r}+X_{2g}+X_{2b}$ serves as the Y stimulus value for white light and $X_{30}=X_{3r}+X_{3g}+X_{3b}$ serves as the Z stimulus value for white light. The nine stimulus values are recorded in a memory device.

Subsequent to mounting the finished backlight to a display panel, the respective R, G and B dies are measured for the standard detected values under a standard environment provided in the plant (such as at a constant temperature of 25° C. and at a well-ventilated site) in a manner described above by the color-photometry sensors 33R, 33G and 33B mounted in the backlight, optionally using a "mutually orthogonal" series of driving signals to carry out the so-called multiple access as described in previous paragraphs to thereby test the LED dies in batch mode. Assuming that the first light source in the group G1 comprises three LED dies $r_1$, $g_i$ and $b_1$, the lights emitted from which present optical detected values of $x_{1r}$, $x_{2r}$, $x_{3r}$; and $x_{1g}$, $x_{2g}$, $x_{3g}$; and $x_{1b}$, $x_{2b}$, $x_{3b}$ by the color-photometry sensors 33R, 33G and 33B, respectively. A linear relationship exists between the nine detected values $x_{ij}$ and the nine stimulus values $X_{ij}$ measured by the "standard photo-detector," which can be described by the following equation:

$$x_{ij}=K_{ij}\cdot X_{ij}\ (i=1, 2, 3; j=r, g, b) \quad (4).$$

Assuming that the light emitted from the LED dies $r_1$, $g_1$ and $b_1$ changes in brightness and chromaticity under a certain operation environment due to variation in ambient temperature or differential decay over time, the optical detected values measured by the color-photometry sensors 33R, 33G and 33B during the test are deviated to a value $x_{ij}'$(i=1, 2, 3; j=r, g, b), wherein $x_{1r}'$, $x_{2r}'$, and $x_{3r}'$ are the values detected by the color-photometry sensors 33R, 33G and 33B upon receiving the light emitted from the LED die $r_1$, and the rest can be reasoned out by analogy. Given that the stimulus values are proportional to the optical detected values, the stimulus values of the three LED dies $r_1$, $g_1$ and $b_1$ can be described by the following equation:

$$X_{ij}' = \frac{x_{ij}'}{x_{ij}} X_{ij} (i = 1, 2, 3;\ j = r, g, b). \quad (5)$$

If the red, green and blue LED dies, when leaving the plant, may together generate white light by being supplied with predetermined power levels having the PWM values of $P_r$, $P_g$ and $P_b$, respectively, the PWM driving values $P_r'$, $P_g'$ and $P_b'$ now become necessary to be provided to the respective LED dies for restoring the brightness and chromaticity levels back to those measured when the LED dies leave the plant. Given that the three stimulus values X, Y and Z remain constant, the relationship can be described by the following equations:

$$P_r'X_{1r}'+P_g'X_{1g}'+P_b'X_{1b}'=P_rX_{1r}+P_gX_{1g}+P_bX_{1b};$$

$$P_r'X_{2r}'+P_g'X_{2g}'+P_b'X_{2b}'=P_rX_{2r}+P_gX_{2g}+P_bX_{2b}; \text{ and}$$

$$P_r'X_{3r}'+P_g'X_{3g}'+P_b'X_{3b}'=P_rX_{3r}+P_gX_{3g}+P_bX_{3b} \quad (6).$$

By substituting the equations above into Equation (5), it gives the following equations:

$$P_r'\frac{x_{1r}'}{x_{1r}}X_{1r}+P_g'\frac{x_{1g}'}{x_{1g}}X_{1g}+P_b'\frac{x_{1b}'}{x_{1b}}X_{1b}=P_rX_{1r}+P_gX_{1g}+P_bX_{1b}; \quad (7)$$

$$P_r'\frac{x_{2r}'}{x_{2r}}X_{2r}+P_g'\frac{x_{2g}'}{x_{2g}}X_{2g}+P_b'\frac{x_{2b}'}{x_{2b}}X_{2b}=P_rX_{2r}+P_gX_{2g}+P_bX_{2b}; \text{ and}$$

$$P_r'\frac{x_{3r}'}{x_{3r}}X_{3r}+P_g'\frac{x_{3g}'}{x_{3g}}X_{1g}+P_b'\frac{x_{3b}'}{x_{3b}}X_{3b}=P_rX_{3r}+P_gX_{3g}+P_bX_{3b}.$$

In Equation (7), the stimulus values $X_{ij}$ are available in the plant, and the values $P_r$, $P_g$ and $P_b$ are known since the brightness and chromaticity of white light are set constant, and the detected values $x_{ij}$ are also available by measurement under the standard environment provided in the plant. If the values $x_{ij}'$ are determined by the optical sensors, fresh PWM driving values $P_r'$, $P_g'$ and $P_b'$ could be obtained using Equation (7). The fresh PWM driving values may then be employed to restore the brightness and chromaticity levels of the light emission from the LED dies $r_1$, $g_1$ and $b_1$ back to those measured when the LED dies leave the plant.

Figure 13:
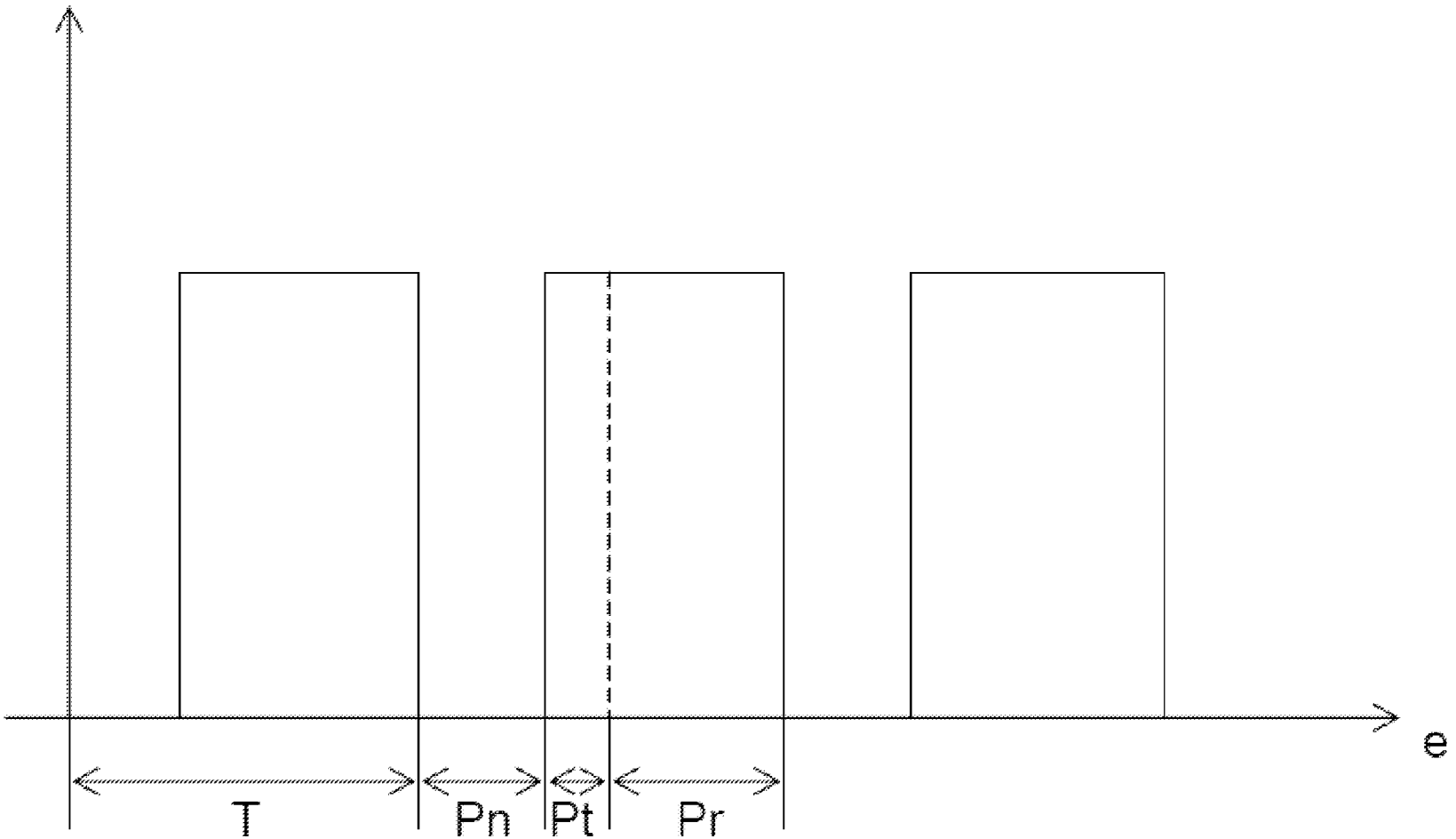
FIG. 13 is a schematic diagram showing a compensation processing over LED reaction time.

Furthermore, according to the invention, all of LED devices mounted in a backlight, such as a total number of 3600 LED devices, can be tested within a short period of time, such as 60×64 μs=3.84 ms, which is much shorter than the normal time interval 16.6 ms necessary for displaying an image frame. As shown in FIG. 13, only a short interval of time Pt is "stolen" from a frame display period T, during which all of the LED devices are forcedly turned off for such an extremely short while that all of the LED devices are tested as described above without drawing any attention from viewers, thereby maintaining the brightness and chromaticity of the display device. The shortened time interval Pr for displaying the image frame still exceeds three-fourth of the original frame display period T. At a display rate of 60 frames per second, the omission of displaying one-fourth of a frame for every 60 frames is substantially unnoticeable by human eyes.

In the case where a deviation in the brightness or chromaticity of a certain LED die cannot be easily compensated for, the processing device will alternatively manage the light emission from the LED devices nearby by commanding the power supplying device to alter the power supply to the nearby LED devices and adjusting the power levels supplied to these LED devices, thereby compensating for the deviation in the overall brightness and chromaticity of the display device.

In conclusion, the invention disclosed herein cannot only perform a rapid test for the luminous effect of respective LED devices but also accomplish the correction and compensation for the poor display performance of a display device, thereby achieving the primary purposes of the invention.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention. For instance, the power supplying device may by way of example comprise a pulse width modulation circuit or a programmable power source. The memory device may include a non-volatile memory device (EEPROM) or a flash memory device.

What is claimed is:

1. A rapid detection method for a decay of a liquid crystal display device having an LED backlight, where said display device comprises a liquid crystal display module and said LED backlight comprises at least one group of LED devices with each group having a plurality of LED devices, and where said display device is provided with at least one optical sensor, a power supplying device for separately actuating the respective LED devices with a variable electric output, a processing device for receiving references values detected by said optical sensor and controlling the electric output of said power supplying device, and a memory device that pre-stores the respective reference values for the respective LED devices which are separately obtained by the optical sensor when the respective LED devices are lighted in an one-by-one manner at at least one given power level, said method comprising the steps of:

a) at a predetermined starting time point, allowing the processing device to command the power supplying device to cut off the power supply to all of the LED devices;

b) powering the group of LED devices to emit light in a synchronized manner by providing test signal data comprised of a plurality of driving signals, wherein the driving signals are mutually orthogonal to one another and have an output power level corresponding to the at least one given power level stored in the memory device;

c) allowing the optical sensor to detect the emitted light from the group of LED devices supplied with the test signal data to obtain a detected value and converting the detected value into an electrical test signal; and d) allowing the processing device to extract respective light emission data for the respective LED devices in the group from the electrical test signal by multiplying the respective driving signals with the detected reference values and compare the respective light emission data for the respective LED devices with the corresponding reference values pre-stored in the memory device.

2. The rapid detection method for decay according to claim 1, wherein if the light emission data deviates from the corresponding pre-stored reference value beyond a predetermined deviation, the method further comprises, subsequent to the comparing step d), a step e) of allowing the processing device to drive the power supplying device to compensate for the deviation.

3. The rapid detection method for decay according to claim 1, wherein the LED devices each have only a single LED.

4. The rapid detection method for decay according to claim 1, further comprising, subsequent to the step d), a looping step f) of lighting and detecting the rest of the groups of LED devices in a group-by-group manner until all of the groups of LED devices are detected and compared with the corresponding reference values pre-stored in the memory device.

5. The rapid detection method for decay according to claim 4, further comprising a time interval-dependent step (g) of recording the time point at which the looping step f) is completed and repeating the step a) to f) whenever the liquid crystal display device is consecutively operated for a predetermined period of time.

6. The rapid detection method for decay according to claim 1, further comprising, prior to the step a), a synchronous-phase detecting step h) for the pre-stored reference values.

7. The rapid detection method for decay according to claim 1, wherein the mutually orthogonal driving signals in the test signal data are numbered to be no less than the amount of the LED devices in the group.

8. The rapid detection method for decay according to claim 1, wherein the mutually orthogonal driving signals in the test signal data include an equal amount of cycles having substantially the same cycle length, and wherein the equal amount of cycles is greater than the number of the driving signals.

9. The rapid detection method for decay according to claim 1, wherein the steps a) to c) are performed during a blanking time between successive frame display sections of the liquid crystal display device.

10. The rapid detection method for decay according to claim 1, wherein the steps a) to c) are performed during a frame display section of the liquid crystal display device.

11. A liquid crystal display device having an LED backlight that is provided with a rapid compensating device for decay, comprising:

a liquid crystal display module;

an LED backlight having plural groups of LED devices with each of the groups having a plurality of LED devices;

at least one optical sensor mounted in the backlight;

a power supplying device for separately actuating the respective LED devices with a variable electric output;

a memory device that pre-stores respective reference values for the respective LED devices which are separately obtained by the optical sensor when the respective LED devices are lighted in an one-by-one manner at least one given power level; and a processing device for driving the power supplying device at a predetermined time point to provide test signal data comprised of a plurality of driving signals, such that one group of the plural groups of LED devices are powered to emit light in a synchronized manner, wherein the driving signals are mutually orthogonal to one another and have an output power level corresponding to the at least one given power level stored in the memory device; and for receiving the reference values detected by the optical sensor upon receiving the emitted light from the group of LED devices; and for extracting respective light emission data for the respective LED devices in the group by multiplying the respective driving signals with the detected reference values and comparing the respective light emission data with the corresponding reference values pre-stored in the memory device; and for varying the electric output of the power supplying device to the respective LED devices if the respective light emission data for the respective LED devices deviate from the corresponding pre-stored reference values beyond a predetermined deviation.

12. The display device according to claim 11, wherein the optical sensor is a phototransistor.

13. The display device according to claim 11, wherein the optical sensor is a color-photometry sensor.

14. The display device according to claim 11, wherein the optical sensor is a solar cell.

15. The display device according to claim 11, wherein the LED backlight is provided with a plurality of LED devices that are adapted for emitting light towards the liquid crystal display panel in a direct manner.

16. The display device according to claim 11, wherein the power supplying device comprises a pulse width modulation generator.

* * * * *